US012077928B2

(12) United States Patent
Bates et al.

(10) Patent No.: US 12,077,928 B2
(45) Date of Patent: Sep. 3, 2024

(54) STEEL AND FOAM FOUNDATION

(71) Applicants: Steve Bates, Draper, UT (US); Dee Bates, Draper, UT (US)

(72) Inventors: Steve Bates, Draper, UT (US); Dee Bates, Draper, UT (US)

( * ) Notice: Subject to any disclaimer, the term of this patent is extended or adjusted under 35 U.S.C. 154(b) by 250 days.

(21) Appl. No.: 17/850,690

(22) Filed: Jun. 27, 2022

(65) Prior Publication Data

US 2023/0417008 A1 Dec. 28, 2023

(51) Int. Cl.
*E02D 27/00* (2006.01)
*E02D 31/06* (2006.01)

(52) U.S. Cl.
CPC ..... *E02D 27/00* (2013.01); *E02D 31/06* (2013.01); *E02D 2300/002* (2013.01); *E02D 2300/0032* (2013.01); *E02D 2300/0082* (2013.01); *E02D 2300/0098* (2013.01)

(58) Field of Classification Search
CPC ... E02D 27/00; E02D 31/06; E02D 2300/002; E02D 2300/0032; E02D 2300/0082; E02D 2300/0098
See application file for complete search history.

(56) References Cited

U.S. PATENT DOCUMENTS 6,354,050 B1 * 3/2002 Pankoski ..... E04B 5/10 52/364
8,925,255 B1 * 1/2015 Haun ..... E04F 11/022 52/91.1
2017/0030072 A1 * 2/2017 Corson ..... E04D 13/1625

FOREIGN PATENT DOCUMENTS

JP 2001172985 A * 6/2001

* cited by examiner

*Primary Examiner* — Mark R Wendell
(74) *Attorney, Agent, or Firm* — Superior IP, PLLC; Dustin L. Call

(57) ABSTRACT

One example embodiment includes a steel and foam foundation. The steel and foam foundation includes a main body, where the main body is formed of EPS foam and a sloped exterior. The sloped exterior is formed of EPS foam on an exterior surface of the main body and ensures that the bottom of the steel and foam foundation is wider than the top of the steel and foam foundation. The steel and foam foundation also includes a first I-beam and a second I-beam. The first and second I-beams are placed on opposite edges of the main body. The steel and foam foundation further includes a first piece of L-metal, a second piece of L-metal, a third piece of L-metal, and a fourth piece of L-metal. Each piece of L-metal includes a first flange and a second flange and is placed around the remaining edges of the main body.

20 Claims, 7 Drawing Sheets

STEEL AND FOAM FOUNDATION

CROSS-REFERENCE TO RELATED APPLICATIONS

Not applicable.

BACKGROUND OF THE INVENTION

Concrete building foundations are a normal part of modern society. In particular, concrete foundations are strong and because the concrete is a liquid before curing, the shapes that need to be formed are easily achievable when compared to stone or wood, which needs to be shaped by removing unnecessary material. In addition, the whole foundation can be a single solid unit, so there are not joints that can slip or move. Finally, concrete foundations are generally stronger than many of the widely accepted alternatives.

However, there are also drawbacks to concrete and other types of foundations. First, the materials are heavy, which means that transportation to the site of installation is expensive. In the case of concrete, the transportation has to be done by a specialty truck because the concrete has to be continually mixed or it will begin curing. This also means that the delivery range is limited and has to be scheduled within a short window of time, or else the concrete becomes unusable.

Second, concrete installation is faster than stone, but still takes time, which cannot be reduced. Concrete has to be formed, poured, cured, cleaned up and finished and those each take time to complete. That is time that other things cannot be done during building of a structure. I.e., walls and flooring can't be placed on the foundation until the concrete is completely cured. This means that the placement of a foundation from beginning to end takes at least 1-2 work weeks before other work can begin.

Third, the installation is highly specialized. Concrete pouring and finishing requires experience and so replacement workers can be difficult to find, especially when they are needed quickly. Indeed, some specialization is so specific, that other concrete workers aren't qualified. For example, the workers who create footings for a structure, do only that and don't do a foundation and vice versa.

All of these add up to concrete foundations being expensive and time consuming. While other materials may be faster, cheaper and stronger, concrete achieves a balance of all three and that is why it has become so universally accepted. However, this does not mean that there are not better alternatives.

Accordingly, there is a need in the art for foundations which require less specialization, which can be installed quicker, which can be cheaper and which are stronger.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a steel and foam foundation. The steel and foam foundation includes a main body, where the main body is formed of EPS foam and a sloped exterior. The sloped exterior is formed of EPS foam on an exterior surface of the main body and ensures that the bottom of the steel and foam foundation is wider than the top of the steel and foam foundation. The steel and foam foundation includes a first I-beam and a second I-beam. The first and second I-beams include a web, a first flange, and a second flange. A first edge of the main body is placed along the web of the first I-beam and a second edge of the main body is placed along the web of the second I-beam, where the second edge is opposite the first edge. The steel and foam foundation also includes a first piece of L-metal, a second piece of L-metal, a third piece of L-metal, and a fourth piece of L-metal. Each piece of L-metal includes a first flange and a second flange. The first piece of L-metal is placed with the first flange on the exterior surface and the second flange on a third edge of the main body where the third edge extends between the first edge and the second edge. The first flange of the first piece of L-metal partially overlaps the first flange of the first I-beam and the first flange of the second I-beam. The second piece of L-metal is placed with the first flange on an interior surface of the main body and the second flange on the third edge of the main body where the interior surface is opposite the exterior surface. The first flange of the second piece of L-metal partially overlaps the second flange of the first I-beam and the second flange of the second I-beam. The third piece of L-metal is placed with the first flange on the exterior surface and the second flange on a fourth edge of the main body. The fourth edge extends between the first edge and the second edge and is opposite the third edge. The first flange of the third piece of L-metal partially overlaps the first flange of the first I-beam and the first flange of the second I-beam. The fourth piece of L-metal is placed with the first flange on the interior surface and the second flange on the fourth edge of the main body. The first flange of the fourth piece of L-metal partially overlaps the second flange of the first I-beam and the second flange of the second I-beam.

Another example embodiment includes a structure. The structure includes a steel and foam foundation. The steel and foam foundation includes a main body, where the main body is formed of EPS foam and a sloped exterior. The sloped exterior is formed of EPS foam on an exterior surface of the main body and ensures that the bottom of the steel and foam foundation is wider than the top of the steel and foam foundation. The steel and foam foundation includes a first I-beam and a second I-beam. The first and second I-beams include a web, a first flange, and a second flange. A first edge of the main body is placed along the web of the first I-beam and a second edge of the main body is placed along the web of the second I-beam, where the second edge is opposite the first edge. The steel and foam foundation also includes a first piece of L-metal, a second piece of L-metal, a third piece of L-metal, and a fourth piece of L-metal. Each piece of L-metal includes a first flange and a second flange. The first piece of L-metal is placed with the first flange on the exterior surface and the second flange on a third edge of the main body where the third edge extends between the first edge and the second edge. The first flange of the first piece of L-metal partially overlaps the first flange of the first I-beam and the first flange of the second I-beam. The second piece of L-metal is placed with the first flange on an interior surface of the main body and the second flange on the third edge of the main body where the interior surface is opposite the exterior surface. The first flange of the second piece of L-metal partially overlaps the second flange of the first I-beam and the second flange of the second I-beam. The third piece of L-metal is placed with the first flange on the exterior surface and the second flange on a fourth edge of the main body. The fourth edge extends between the first edge and the second edge and is opposite the third edge. The first flange of the third piece of L-metal partially overlaps the first flange of the first I-beam and the first flange of the second I-beam. The fourth piece of L-metal is placed with the first flange on the interior surface and the second flange on the fourth edge of the main body. The first flange of the fourth piece of L-metal partially overlaps the second flange of the first I-beam and the second flange of the second I-beam. The structure also includes a footing, where the steel and foam foundation is attached to the footing.

Another example embodiment includes a structure. The structure includes a steel and foam foundation. The steel and foam foundation includes a main body, where the main body is formed of EPS foam and a sloped exterior. The sloped exterior is formed of EPS foam on an exterior surface of the main body and ensures that the bottom of the steel and foam foundation is wider than the top of the steel and foam foundation. The steel and foam foundation includes a first I-beam and a second I-beam. The first and second I-beams include a web, a first flange, and a second flange. A first edge of the main body is placed along the web of the first I-beam and a second edge of the main body is placed along the web of the second I-beam, where the second edge is opposite the first edge. The steel and foam foundation also includes a first piece of L-metal, a second piece of L-metal, a third piece of L-metal, and a fourth piece of L-metal. Each piece of L-metal includes a first flange and a second flange. The first piece of L-metal is placed with the first flange on the exterior surface and the second flange on a third edge of the main body where the third edge extends between the first edge and the second edge. The first flange of the first piece of L-metal partially overlaps the first flange of the first I-beam and the first flange of the second I-beam. The second piece of L-metal is placed with the first flange on an interior surface of the main body and the second flange on the third edge of the main body where the interior surface is opposite the exterior surface. The first flange of the second piece of L-metal partially overlaps the second flange of the first I-beam and the second flange of the second I-beam. The third piece of L-metal is placed with the first flange on the exterior surface and the second flange on a fourth edge of the main body. The fourth edge extends between the first edge and the second edge and is opposite the third edge. The first flange of the third piece of L-metal partially overlaps the first flange of the first I-beam and the first flange of the second I-beam. The fourth piece of L-metal is placed with the first flange on the interior surface and the second flange on the fourth edge of the main body. The first flange of the fourth piece of L-metal partially overlaps the second flange of the first I-beam and the second flange of the second I-beam. The structure also includes a footing, where the steel and foam foundation is attached to the footing. The structure further includes a floor panel placed on top of the third edge of the main body and attached to the first piece of L-metal and the second piece of L-metal. The structure additionally includes waterproofing, where the waterproofing is applied to at least the sloped exterior. The structure moreover an exterior wall, the exterior wall placed on top of the floor panel. The structure also includes an exterior finish, where the exterior finish covers a portion of the main body, the first flange of the first I-beam, the first flange of the second I-beam, the first flange of the first piece of L-metal, a portion of the floor panel and a portion of the exterior wall.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
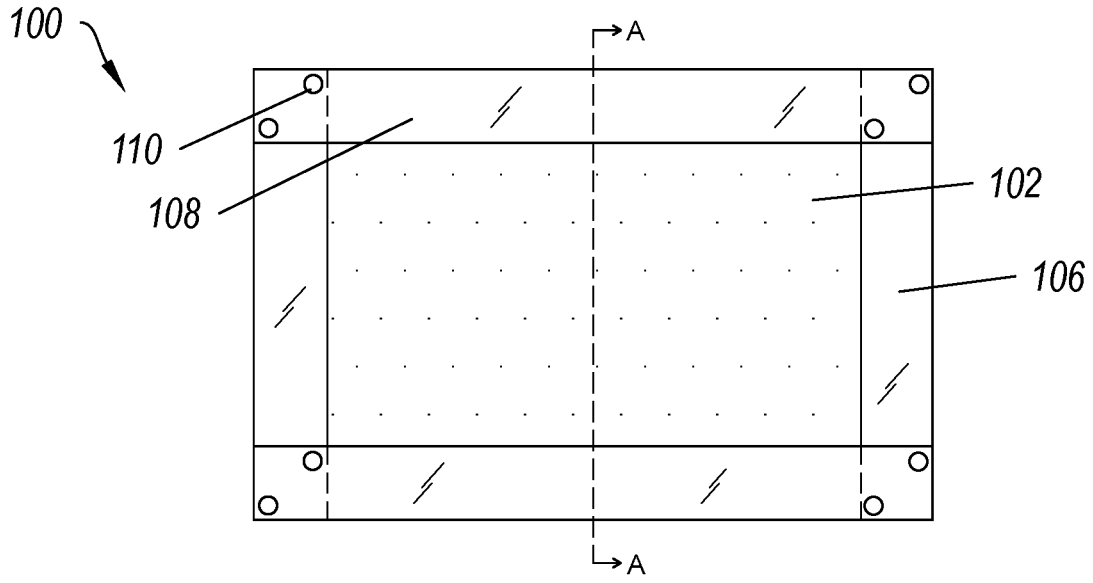
FIG. 1A illustrates an interior view of the example of a steel and foam foundation.
Figure 1B:
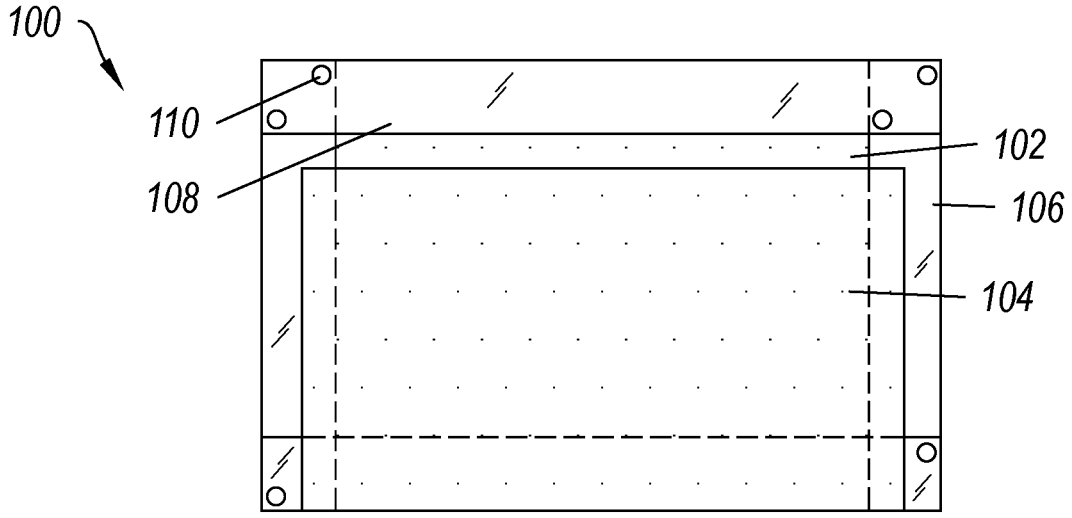
FIG. 1B illustrates an exterior view of the example of a steel and foam foundation.
Figure 1C:
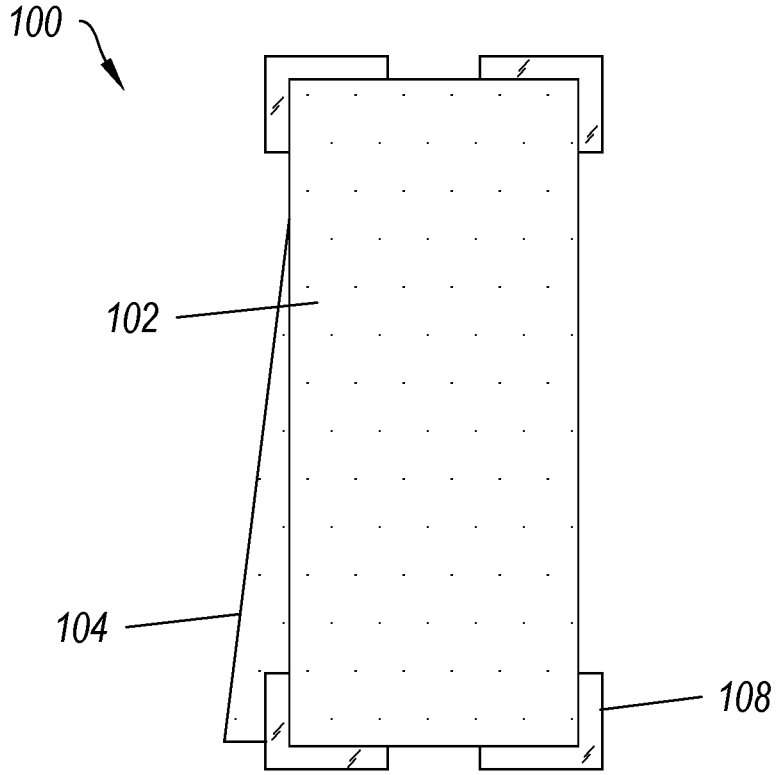
FIG. 1C illustrates a cross-sectional view of the example of a steel and foam foundation along the line A-A of FIG. 1A.
Figure 1D:
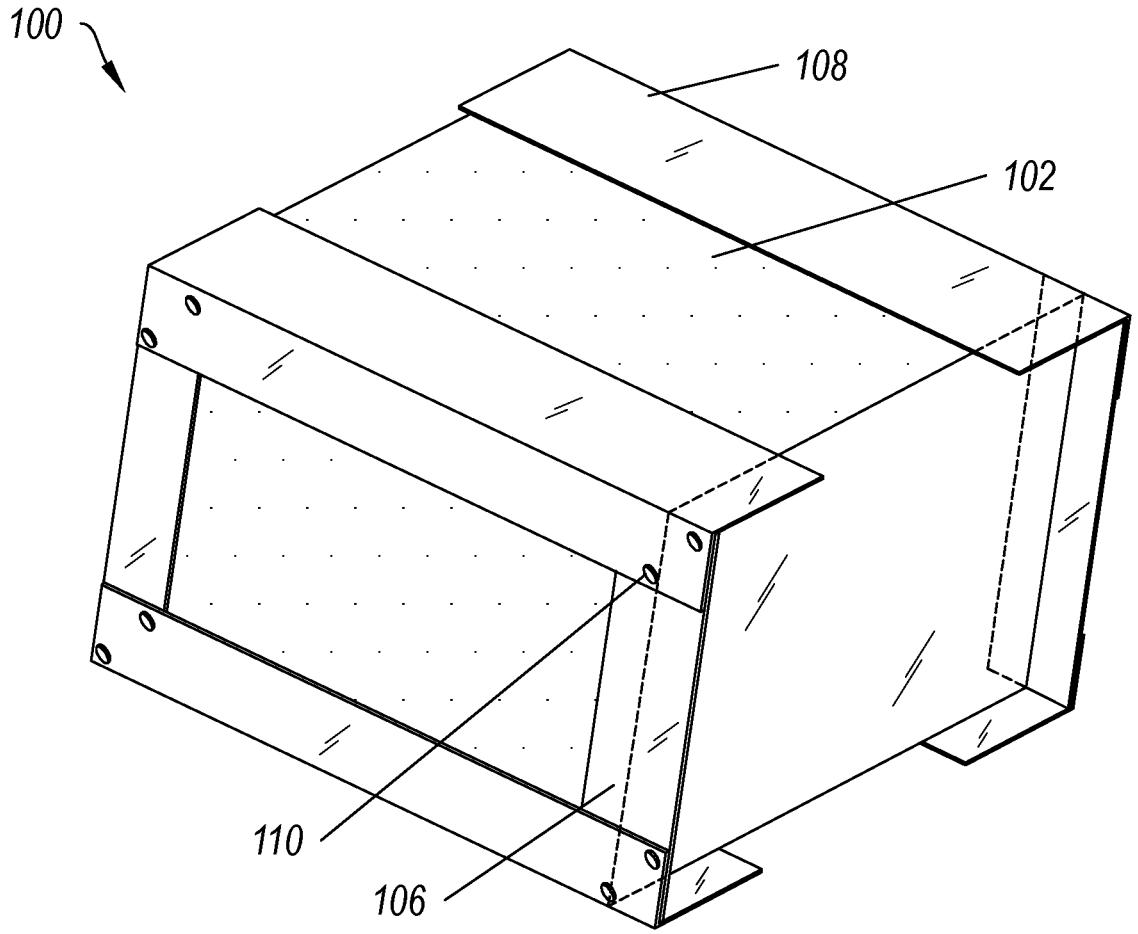
FIG. 1D illustrates a perspective view of the example of a steel and foam foundation.

FIGS. 1A-1D (collectively "FIG. 1") illustrate an example of a steel and foam foundation 100. FIG. 1A illustrates an interior view of the example of a steel and foam foundation 100; FIG. 1B illustrates an exterior view of the example of a steel and foam foundation 100; FIG. 1C illustrates a cross-sectional view of the example of a steel and foam foundation 100 along the line A-A of FIG. 1A; and FIG. 1D illustrates a perspective view of the example of a steel and foam foundation 100. In engineering, a foundation is the element of a structure which connects it to the ground, transferring loads from the structure to the ground. Foundations serve several purposes, including but not limited to:

- Distributing the weight of the structure over a large area in order to avoid overloading the underlying soil (possibly causing unequal settlement).
- Anchoring the structure against natural forces including earthquakes, floods, droughts, frost heaves, tornadoes and wind.
- Providing a level surface for construction.
- Anchoring the structure deeply into the ground, increasing its stability and preventing overloading.
- Preventing lateral movements of the supported structure (in some cases).

The steel and foam foundation 100 includes a number of benefits relative to concrete foundations (which were, in turn, a vast improvement over previous foundations, such as stone and mortar). The steel and foam foundation 100 is cheaper than a concrete foundation. For instance, the steel and foam foundation 100 can be a cost reduction of 25-50% relative to a concrete foundation. By way of example, in a typical home with a basement the size of the foundation can be (lets put an example here—I would like some dimensions, total material and approximate cost—for example, it could say "the foundation can be 12" wide, 8' tall and 100 linear feet. This would require 29.6 cubic feet of concrete. At a cost of $119-$147 per cubic yard, the total cost of this example foundation would be roughly $3,500-$4,500—obviously, these numbers are just made up so put in something that is realistic. In contrast, the steel and foam foundation 100 for the same structure would be roughly (put a number here matching the material cost for the steel and foam foundation that would replace the above concrete foundation—the bigger the contrast here, the better, but keep in reasonable. So if you think the same foundation could be $1,500-$2,000 then be honest and put that here). As an additional example (we can do the same thing for a shorter foundation for a building without a basement if you would like).

Another benefit of the steel and foam foundation 100 relative to a concrete foundation is strength. The steel and foam foundation 100 is about 3 times the strength of an equivalent concrete foundation. Under testing the steel and foam foundation 100 using gauge steel and 2 lb density foam (if you think any other factors are relevant, feel free to put here—dimensions might be helpful if that changes the test results) withstood a downward pressure of 20,510 psi (the label says 20,510 pounds down pressure so I wasn't sure whether that was 20,510 lbs total or 20,510 psi, so I guessed and put that here) where the test is conducted applying a pressure and removing all pressure (i.e., the test ends) when any portion of the test material fails. The same test puts the strength of a concrete foundation at 7,000 psi. This equates to an roughly three-fold strength increase of the steel and foam foundation 100 relative to a concrete foundation.

An additional benefit of the steel and foam foundation 100 relative to a concrete foundation is speed of construction/installation. Installation of a concrete foundation is much more time and space intensive relative to the steel and foam foundation 100. Construction of a concrete foundation takes several days under normal conditions. The usual process is as follows. First forms for the concrete pour are prepared. This is often done 2-3 days prior to the day of the concrete pour to ensure that if any problems are encountered, they can be corrected prior to the arrival of the concrete. The forms are slabs that are attached to one another or flat materials (such as plywood) that can be secured to one another. This forms a space into which the concrete is poured and the forms are left until the concrete has at least partially cured (the internal portions need not be cured for forms to be removed). Because the forms need to be supported, the trench for the foundation often must be made wide enough for a worker and supports to have space on the outside of the forms. Concrete is then delivered in specialized cement trucks and placed into the forms. After curing is complete (or complete enough) the forms are removed leaving the concrete foundation. The forms are then removed from the site. This whole process can be completed in 3-5 work days under ideal conditions, but in practice often takes 7-10 work days or more (for example, if a freeze happens then additional time must be given as concrete will not cure at temperature below freezing).

In contrast, the steel and foam foundation 100 requires less time and less space dug around the foundation. The steel and foam foundation 100 is delivered in pieces that are assembled on site. Thus, the only materials that have to be present are the steel and foam foundation 100 itself. While this can, in theory, be done for a concrete foundation the reality is that doing so would require cranes and other equipment which makes such an installation more expensive and less practical, so it is rarely done in practice. Each section of the steel and foam foundation 100 comes numbered so that assembly proceeds by placing the correct portion of the steel and foam foundation 100 and securing to the footings (described below). Because the steel and foam foundation 100 sections are light enough to be manipulated by hand, they can be placed and secured in a relatively short amount of time. A home with a basement can have the entire foundation assembled and installed within a single day and this installation time is not affected by the weather. This is a significant time savings compared to a concrete foundation. In addition, although space would normally be given for a worker to access the outside of the steel and foam foundation 100, this space is much less (about half the width—not sure if this is accurate, but it seemed about right) that would be required for a concrete foundation which needs to accommodate workers and braces for the forms. Less space needed for the foundation translates to less time and cost of digging the foundation and less time and cost for backfilling.

Moreover, the transportation time and costs for the steel and foam foundation 100 is significantly reduced relative to the transportation time and costs of a concrete foundation. Transportation of concrete requires a cement truck (which constantly mixes the concrete to slow curing) and is distance limited. Beyond a certain distance (should put in the distance here—can change to delivery time if needed), concrete cannot be transported premixed, or it will cure before delivery. Beyond that distance one of two options must be utilized. Either the dry concrete is delivered and then mixed in a cement truck on site, or (in harder to reach areas, such as sites with poor access) the dry concrete has to be mixed by hand. Both options dramatically increase the cost and the time required for the concrete pour (some numbers here would be great). In contrast, the steel and foam foundation 100 can be delivered by a variety of means. Usually, this would be accomplished on a flat bed truck but can be done using pickup trucks or trailers if access is poor. Indeed, the weight of each portion of the individual steel and foam foundation 100 is low enough that it could be delivered on something as small as an ATV if required.

A further benefit is that backfilling can occur much faster with the steel and concrete 100 foundation. For example, when a concrete pour is completely finished (day 1) it is usually left overnight. The following day (day 2), forms are removed and then taken off the site. The day after that (day 3) asphalt or other waterproofing is applied to any areas that will be backfilled. Finally, after allowing the asphalt to dry (not sure if this is the correct term) (usually overnight, so on day 4) backfill is placed in the area surrounding the foundation. Thus, this process takes four days or more once the concrete is poured. In contrast, the steel and concrete foundation can be installed and asphalt applied on the same day. Then the next day backfill can be placed in the area surrounding the foundation (which is smaller than required for a concrete foundation, as described above). Thus, backfilling begins within 1-2 days vs 3-4 days and is less labor intensive (as materials such as forms do not have to be removed from the site).

FIG. 1 shows that the steel and foam foundation 100 can include a main body 102. The main body 102 can be formed from expanded polystyrene ("EPS") foam. For example, the main body can be two-pound EPS foam (i.e., a density of two pounds per cubic foot). EPS is a is a rigid and tough, closed-cell foam made of pre-expanded polystyrene (Poly (1-phenylethane-1,2-diyl—molecular formula $(C_8H_8)_n$) beads. EPS is inert and stable and does not produce methane gas or contaminating leachates. EPS manufacturing uses little energy, in which steam is a component of the manufacturing process. The water from this process is collected and re-used many times. Additionally, only 0.1% of total oil consumption is used to manufacture EPS. Scrap EPS generated during manufacturing or from jobsite waste can be ground up and incorporated into new EPS products. EPS is recyclable and can be turned into new EPS products or thermally processed into a resin to make other products such as garden furniture, coat hangers and crown molding. According to the Environmental Protection Agency (EPA), buildings in the US alone account for 36% of energy use and 30% of greenhouse gas emissions. Using EPS in commercial and residential construction helps to reduce energy consumption and greenhouse gas emissions. EPS has higher, more stable long term R-Values than other insulation alternatives. R-Value measures the thermal resistance. The higher the R-Value the better a product insulates a building. EPS has an R-Value of roughly 4.75R per inch. The main body 102 can have an R-value of (put in a value if you have one).

One of skill in the art will appreciate that one advantage of EPS includes the ability to add dyes. I.e., the EPS can be dyed to make it any desired color. This allows the material to be customized as desired by a user and provide a desired look. The number of colors available in EPS is extremely high. In contrast, the number of colors that can be created in concrete is highly limited and, therefore, other looks are created with paint placed on the outside of the concrete.

FIG. 1 also shows that the steel and foam foundation 100 can include a sloped exterior 104. The sloped exterior 104 is configured to direct pressure from the overlaying structure and the fill material sitting against the foundation wall downward through the foundation into the footing (you may have a better way to describe this). This increases the strength of the steel and foam foundation 100 since the pressure is no longer inward but is instead now downward. Thus, the sloped exterior 104 is critical to ensure that the pressure is being directed as desired. As used in the specification and the claims, the phrase "configured to" denotes an actual state of configuration that fundamentally ties recited elements to the physical characteristics of the recited structure. That is, the phrase "configured to" denotes that the element is structurally capable of performing the cited element but need not necessarily be doing so at any given time. Thus, the phrase "configured to" reaches well beyond merely describing functional language or intended use since the phrase actively recites an actual state of configuration.

Further the sloped exterior 104 prevents water from draining along the main body 102. That is, the sloped exterior ensures that the exterior never slopes inward in such that water which is in the soil never drains into a cavity formed by the steel and foam foundation 100 and an underlying structure (such as a footing, described below). This prevents water damage and allows the structure to resist water damage for as long as possible. Therefore, the sloped exterior 104 is also critical to prevent water damage. To create the proper pressure direction and water drainage, the slope of the sloped exterior 104 should be between 4.5 and 7.5 inches over 10 feet (i.e., if the height of the sloped exterior 104 is 10 feet then the base of the sloped exterior is between 4.5 and 7.5 inches but if the height of the sloped exterior 104 is 5 feet then the base of the sloped exterior is between 2.25 and 3.75 inches). For example, the slope of the sloped exterior 104 can be approximately 6 inches over 10 feet. As used in the specification and the claims, the term approximately shall mean that the value is within 10% of the stated value, unless otherwise specified.

The sloped exterior 104 is configured to go roughly to the ground line. I.e., the sloped exterior 104 ends not at the top of the main body 102 but instead wherever the soil will be backfilled along the foundation wall. This keeps the exterior of the structure looking clean and straight but allows the sloped exterior 104 to direct the pressure on the main body 102, as described above. In addition, the sloped exterior 104 does not need to be above ground level as it isn't needed for soil pressure or soil water drainage.

FIG. 1 further shows that the steel and foam foundation 100 can include an I-beam 106. An I-beam, also known as H-beam, W-beam (for "wide flange"), Universal Beam (UB), Rolled Steel Joist (RSJ), or double-T (especially in Polish, Bulgarian, Spanish, Italian and German), is a beam with an I- or H-shaped cross-section. The horizontal elements of the "I" are flanges, while the vertical element is termed the web. The I-shaped section is a very efficient form for carrying both bending and shear loads in the plane of the web.

The I-beam 106 is placed along the right and left sides of the main body 102. I.e., the flanges are along the exterior and the interior surfaces of the main body 102 and in a slot along the sloped exterior 104. The main body 102 is in contact with the interior of the flanges and the web of the I-beam 106 (with the adjacent main body 102 in the interior of the opposite flange and web of the I-beam 106). Thus, the width of the web of I-beam 106 (the distance between the flanges) is equal to the size of the width of the main body 102. A portion of the sloped exterior 104 is on the exterior of the flange of the I-beam 106 (the side not in contact with the web).

FIG. 1 additionally shows that the steel and foam foundation 100 can include L-metal 108. The L-metal 108 is a beam with an "L" shaped cross-section. I.e., there are two flanges that are set 90 degrees relative to one another. The L-metal 108 is placed along the bottom and the top of the main body 102 (two pieces along each edge). This allows for easier connection to other structures, as described below. The main body 102 is in contact with the interior of the flanges of the L-metal 108 (i.e., in the 90-degree corner). A portion of the sloped exterior 104 is on the exterior of one of the flanges of the L-metal 108. The size of the L-metal 108 can be dependent on the size of the main body 102. In particular, the L-metal 108 from opposite surfaces shouldn't overlap. I.e., if the width of the main body 102 is 8 inches, then one flange of the L-metal 108 should be less than 4 inches, to prevent overlap. The L-metal 108 need not be as large on the top of the steel and foam foundation 100 as on the bottom of the steel and foam foundation 100 (need an explanation if we have one). For example, in an 8-inch main body the flange of the L-metal 108 on the bottom of the steel and foam foundation 100 can be approximately 3.5 inches (for the flange on the exterior or interior) and the size of the other flange can be approximately 3 inches (for the flange on the bottom surface). Similarly, in an 8-inch main body the flange of the L-metal 108 on the top of the steel and foam foundation 100 can be approximately 1.5 inches (for the flange on the exterior or interior) and the size of the other flange can be approximately 3 inches (for the flange on the bottom surface).

FIG. 1 moreover shows that the steel and foam foundation 100 can include one or more fasteners 110. The fasteners 110 secure the L-metal 108 to the I-beam 106. For example, the one or more fasteners 110 can include self-tapping screws that pass through the L-metal 108 and then the I-beam 106. While the fasteners 110 would then pass into the main body 102, they don't have any structural benefit, since they don't hold into the EPS foam. While other forms of attachment (for example, welding) may be sufficient to keep the L-metal 108 and the I-beams 106 in place, installation would take much longer, thus reducing or removing on of the key benefits. Thus, the fasteners are critical to ensuring that the L-metal 108 and the I-beam 106 remain in place.

One of skill in the art will appreciate that if the flanges of the I-beam 106 or the L-metal 108 are within a grove between the main body 102 and the sloped exterior 104 then the fasteners 110 can't be placed. However, the sloped exterior 104 can be glued or attached to the main body 102 after the fasteners 110 are placed without any loss of benefit. So, the groove between the main body 102 and the sloped exterior 104 is created after the fasteners are inserted into the L-metal 108 and the I-beam 106.

Figure 2A:
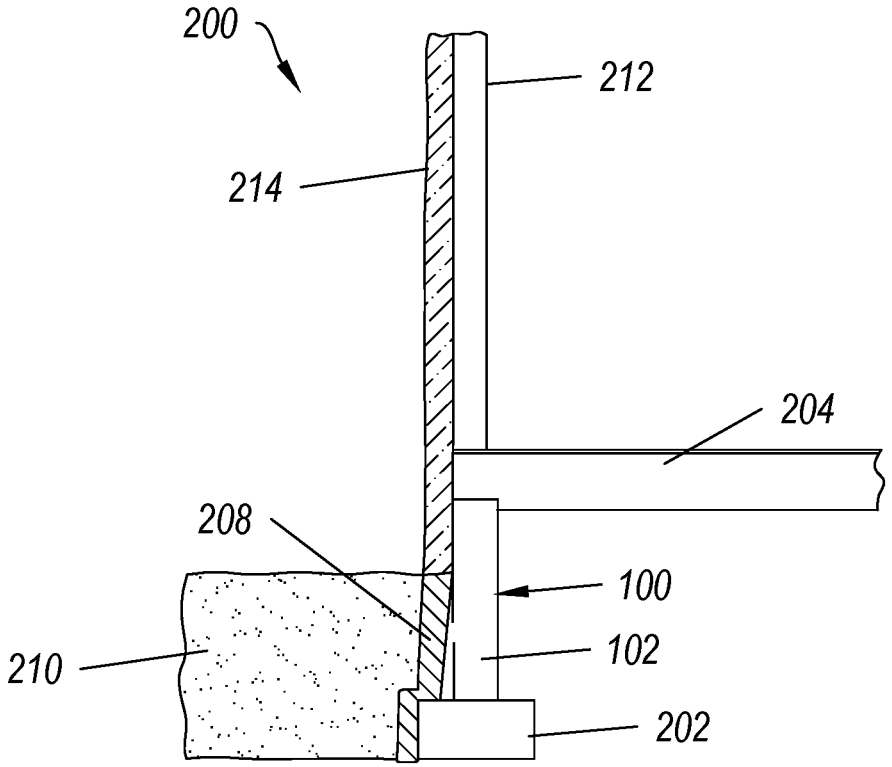
FIG. 2A illustrates an example of a structure which includes a steel and foam foundation.
Figure 2B:
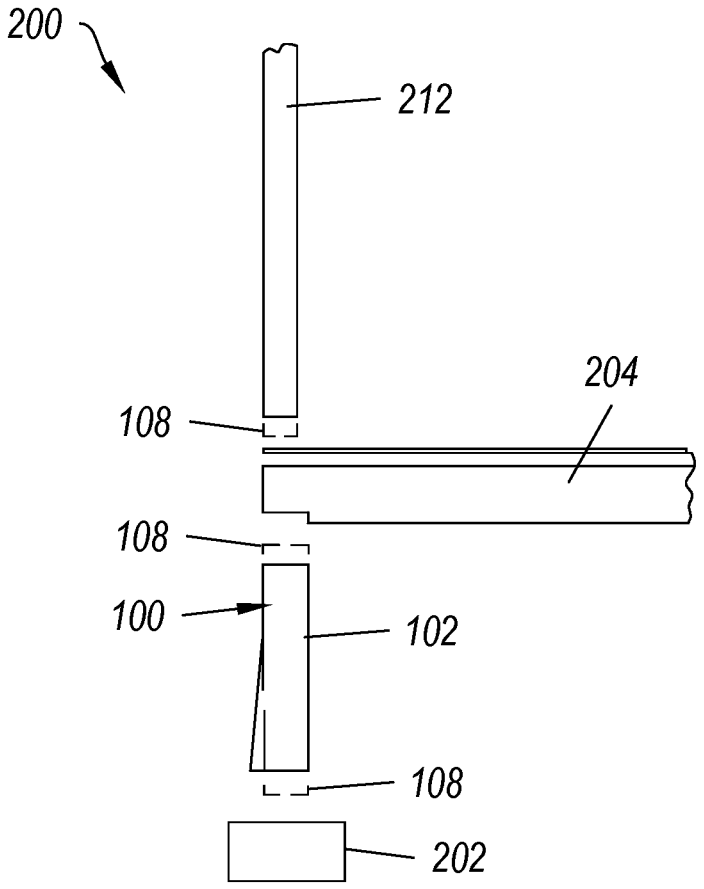
FIG. 2B illustrates an expanded view of an example of a structure which includes a steel and foam foundation.

FIGS. 2A and 2B (collectively "FIG. 2") illustrate an example of a structure 200 which includes a steel and foam foundation 100. FIG. 2A illustrates an example of a structure 200 which includes a steel and foam foundation 100; and FIG. 2B illustrates an expanded view of an example of a structure 200 which includes a steel and foam foundation 100. The structure can be constructed in accordance with the methods and systems disclosed in U.S. Non-Provisional patent application Ser. No. 16/269,329 filed on Jul. 22, 2021 (which claims priority to U.S. Non-Provisional patent application Ser. No. 15/302,161 filed on Oct. 5, 2016, PCT Patent Application No. PCT/IB2015/050890 filed on Feb. 5, 2015, U.S. Non-Provisional patent application Ser. No. 14/173,713 filed on Feb. 5, 2014, U.S. Non-Provisional patent application Ser. No. 14/173,696 filed on Feb. 5, 2014, U.S. Non-Provisional patent application Ser. No. 14/173,703 filed on Feb. 5, 2014, U.S. Non-Provisional patent application Ser. No. 14/173,721 filed on Feb. 5, 2014) which is incorporated herein by reference in its entirety.

FIG. 2 shows that the structure 200 can include a footing 202. FIG. 2 shows that the steel and foam foundation 100 is different from a footing 202 although they are sometimes used interchangeably in engineering or other literature (or the term "foundation" is used to designate both a foundation and footing 202). Sometimes the term "foundation wall" is used to distinguish a foundation from the footing 202. On a basic level, the footing 202 is the structure which rests directly on the ground or soil and foundations are the portion of the structure which rests on the footing 202, transferring the weight of the superstructure to the footing 202, where it is, in turn, transferred to the ground. In other words, a foundation can be analogized to a leg and footing 202 is analogized to the foot.

Although this seems to be a somewhat arbitrary distinction, in practice the footing 202 and the foundation are distinct structures that are produced independent of one another so the difference during construction is clear. In a smaller building requiring a shallow foundation (i.e., not a deeper foundation such as pilings) such as a residence, the footing 202 consists of strips or pads of concrete (or other materials) which extend below the frost line and transfer the weight from walls and columns to the soil or bedrock whereas the foundation is the basement, crawl space or ground floor walls (depending on the depth on the footing 202). So, for example, when a house is built with concrete footing 202 and concrete foundation, the footings are created and poured, and then the concrete foundation is created on top of the footing. The two are created at different times and usually by different work crews (i.e., crews typically specialize in one or the other but not both). So, in the best-case scenario, the footing is poured and finished (day 1) and the next day (day 2—after the footing concrete has cured) the forms for the footing are removed and the forms for the foundation can be placed. Then the next day (day 3) the concrete for the foundation is poured and on day 4 the forms are removed completing the process, which means that the superstructure can be assembled on day 5. In reality, most construction supervisors don't want to schedule one step immediately after the other, as any delay can cause logistical problems.

In contrast, the steel and foam foundation 100 can be placed much sooner than a concrete foundation. The steel and foam foundation 100 can be on site and ready to place as soon as the footing 202 are placed. This means that the footing 202 is poured and finished (day 1) and the next day (day 2—after the footing 202 concrete has cured) the forms for the footing 202 are removed and the steel and foam foundation 100 can be placed. This doesn't create the same logistical problems because a specialized crew is not needed to place the steel and foam foundation 100 and because the placing of the steel and foam foundation 100 can be placed simultaneously with or prior to the removal of the forms for the footing 202 if desired. In addition, the superstructure can be placed with the steel and foam foundation 100 only partially complete. I.e., the superstructure can be placed on the steel and foam foundation 100 immediately after placement. Thus, the superstructure can be assembled on day 2, rather than day 5 or later.

FIG. 2 also shows that the L-metal 108 of the steel and foam foundation 100 rests directly on the footing 202. The L-metal 108 is attached to the footing 202 via (I'm not sure from the drawings how the attachment is completed, but we'll want to add that here).

FIG. 2 further shows that a floor panel 204 is placed on top of the steel and foam foundation 100. The floor panel 204 can be a steel and foam floor panel or can include conventional materials, such as floor joists. If the floor panel 204 is a steel and foam floor panel it can be constructed to have a notch which mates with the steel and foam foundation 100. For example, the floor panel 204 can be ten inches thick except at the edge where it is only 8 inches think (leaving 2 inches to drop down into the crawl space 206 created under the floor panel 204). The floor panel 204 can include an I-beam which is attached to the L-metal 108 on the top of the steel and foam foundation 100. I.e., the floor panel 204 is placed by attaching an I-beam to the L-meal 108 on both sides of the steel and foam foundation 100. A foam panel is then placed with an edge in the I-beam and a second I-beam is then placed on the opposing edge of the foam panel (or a second I-beam is placed and a foam panel is inserted into the gap between the I-beams).

FIG. 2 additionally shows that the structure 200 can include waterproofing 208. The waterproofing 208 is usually an asphalt based coating which is sprayed on the steel and foam foundation 100 and footing 202 (not sure if this part about the footing is true). The asphalt then hardens, forming a waterproof coating, preventing any moisture from the ground from penetrating the footing 202 or the steel and foam foundation 100, and the interior of the crawl space 206. (probably other benefits we should mention here).

FIG. 2 moreover shows that the structure 200 can include fill 210. The fill 210 is dirt that is placed along the exterior of the footing 202 and steel and foam foundation 100. I.e., the fill 210 is placed around the exterior of the footing 202 and steel and foam foundation 202, restoring the dirt/soil which was removed to allow the placement of the footing 202 and the steel and foam foundation 202. Thus, the level of the ground on the exterior of the structure 200 is created.

FIG. 2 also shows that the structure 200 can include an exterior wall 212. The exterior wall 212 is placed on the floor panel 204, complete the exterior of the structure 202. The exterior wall 212 can include a conventional wall (such as wood, stone, brick, etc.) or can be made of steel and foam, as described above.

FIG. 2 additionally shows that the if the exterior wall 212 is made of steel and foam that the exterior wall 212 can be attached using L-metal 108. The L-metal 108 is attached to the floor panel 204 on the top surface in the same manner as the L-metal 108 of the steel and foam foundation 100 attached to the bottom surface of the floor panel 204.

FIG. 2 further shows that the structure 200 can include an exterior finish 214. The exterior finish 214 can include any desired finish, such as crete, stucco, siding, etc. Thus, a view cannot tell the difference on the exterior between the structure 200, including the steel and foam foundation 100, and any other conventional structure.

Figure 3A:
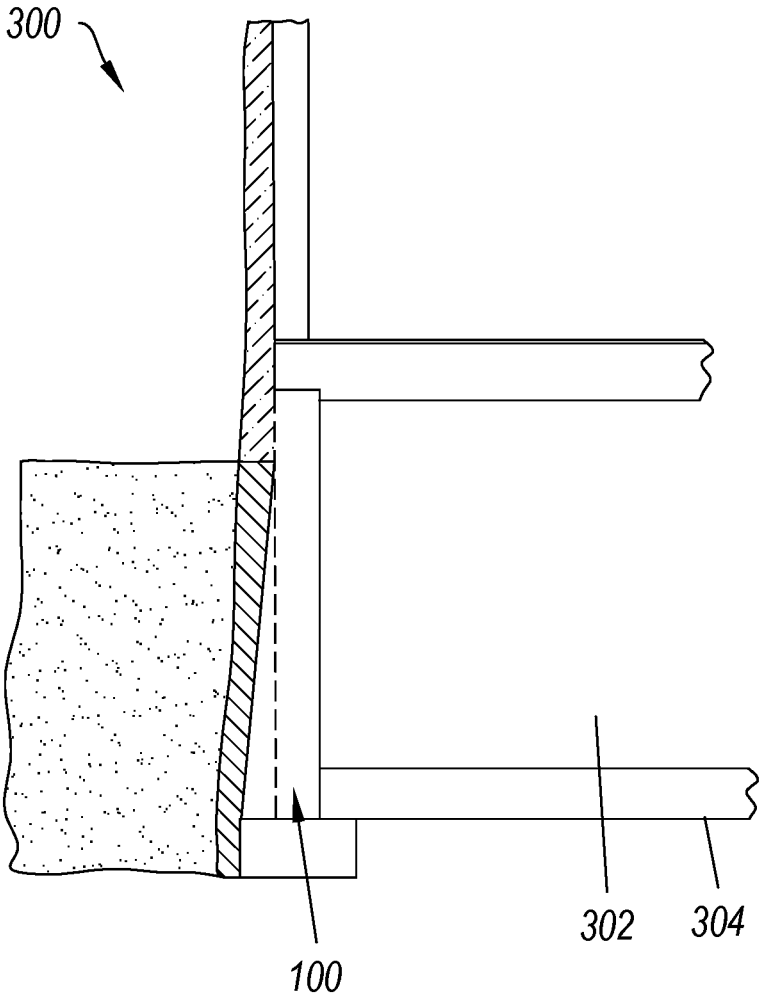
FIG. 3A illustrates an example of a structure with a basement that includes a steel and foam foundation.
Figure 3B:
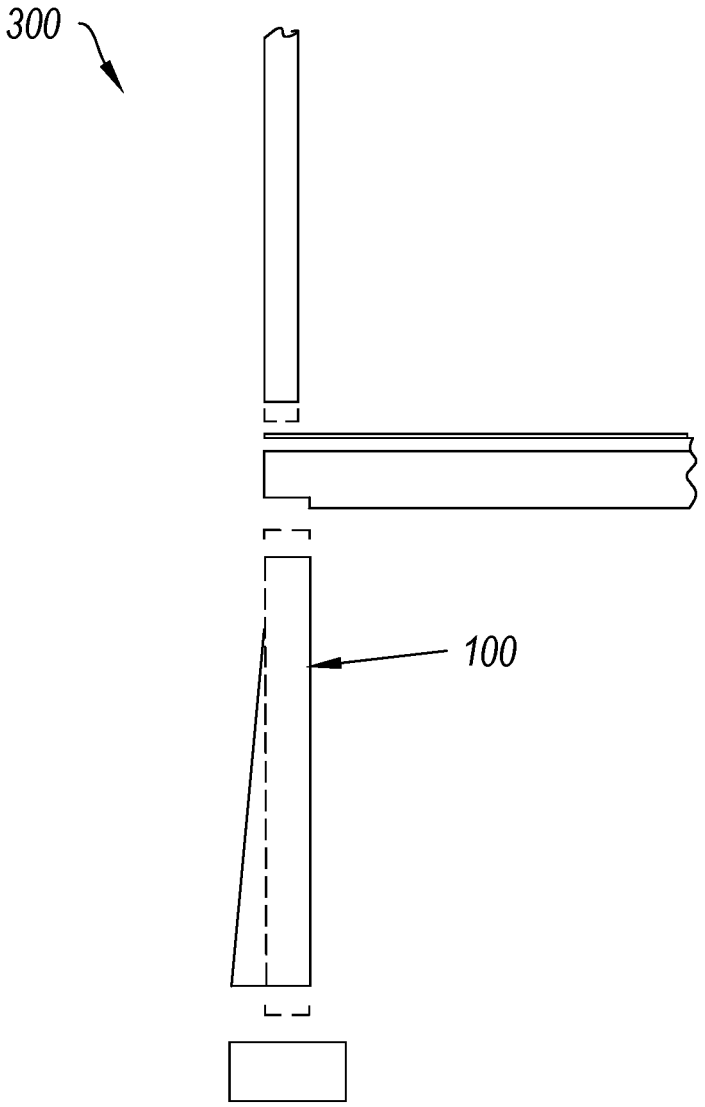
FIG. 3B illustrates an expanded view of an example of a structure with a basement that includes a steel and foam foundation.

FIGS. 3A and 3B (collectively "FIG. 3") illustrate an example of a structure 300 with a basement 302 that includes a steel and foam foundation 100. FIG. 3A illustrates an example of a structure 300 with a basement 302 that includes a steel and foam foundation 100; and FIG. 3B illustrates an expanded view of an example of a structure 300 with a basement 302 that includes a steel and foam foundation 100. The basement 302 or cellar is one or more floors of a building that are completely or partly below the ground floor. The basement 302 may be used as a utility space for a building, where such items as the furnace, water heater, breaker panel or fuse box, car park, and air-conditioning system are located; so also are amenities such as the electrical system and cable television distribution point. Alternatively, basements 302 can be finished used as living space. For example, the basement 302 can be habitable, with windows and its own access.

To create the basement, the steel and foam foundation 100 can be larger than in the structure 200 of FIG. 2. For example, the steel and foam foundation 100 can be nine feet tall and eight inches thick (versus three feet tall and eight inches thick in the structure 200 of FIG. 2.

FIG. 3 shows that the structure 300 can include a ground floor 304. A crawlspace typically has a dirt or soil floor, since it isn't used as a floor (utilities in a crawl space are usually mounted on the wall or the underside of the floor). In contrast the ground floor 304 creates more usable space. The ground floor 304 can be similar to the floor panel 204 of FIG. 2, but placed directly on the footings, or can include concrete that is poured between the footings (part of the concrete may be on top of the footings, just as in buildings with concrete foundations, where the foundation acts as a form for the concrete).

I'm assuming there is a finish on the interior of the foundation since it's a basement, but don't have any details.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A steel and foam foundation, the steel and foam foundation comprising:

a main body, wherein the main body is formed of EPS foam;

a sloped exterior, wherein the sloped exterior:
- is formed of EPS foam;
- on an exterior surface of the main body; and
- ensures that the bottom of the steel and foam foundation is wider than the top of the steel and foam foundation;

a first I-beam, wherein:
- the first I-beam includes:
  - a web;
  - a first flange; and
  - a second flange; and
- a first edge of the main body is placed along the web of the first I-beam;

a second I-beam, wherein:
- the second I-beam includes:
  - a web;
  - a first flange; and
  - a second flange; and
- a second edge of the main body:
  - is placed along the web of the second I-beam; and
  - is opposite the first edge;

a first piece of L-metal, wherein:
- the first piece of L-metal includes:
  - a first flange; and
  - a second flange;
- the first piece of L-metal is placed with the first flange on the exterior surface and the second flange on a third edge of the main body;
- the third edge extends between the first edge and the second edge; and
- the first flange of the first piece of L-metal partially overlaps:
  - the first flange of the first I-beam; and
  - the first flange of the second I-beam;

a second piece of L-metal, wherein:
- the second piece of L-metal includes:
  - a first flange; and
  - a second flange;
- the second piece of L-metal is placed with the first flange on an interior surface of the main body and the second flange on the third edge of the main body; and
- the interior surface is opposite the exterior surface;
- the first flange of the second piece of L-metal partially overlaps:
  - the second flange of the first I-beam; and
  - the second flange of the second I-beam;

a third piece of L-metal, wherein:
- the third piece of L-metal includes:
  - a first flange; and
  - a second flange;
- the third piece of L-metal is placed with the first flange on the exterior surface and the second flange on a fourth edge of the main body; and
- the fourth edge:
  - extends between the first edge and the second edge; and
  - is opposite the third edge; and
- the first flange of the third piece of L-metal partially overlaps:
  - the first flange of the first I-beam; and
  - the first flange of the second I-beam; and a fourth piece of L-metal, wherein:

the fourth piece of L-metal:
includes:
a first flange; and
a second flange;
is placed with the first flange on the interior surface and the second flange on the fourth edge of the main body; and
the first flange of the fourth piece of L-metal partially overlaps:
the second flange of the first I-beam; and
the second flange of the second I-beam.

2. The steel and foam foundation of claim 1, wherein the EPS foam is approximately two pound density.

3. The steel and foam foundation of claim 1, wherein the EPS foam is dyed.

4. The steel and foam foundation of claim 1, wherein the slope of the sloped exterior is between 4.5 inches and 7.5 inches over 10 feet.

5. The steel and foam foundation of claim 4, wherein the slope of the sloped exterior is approximately 6 inches over 10 feet.

6. The steel and foam foundation of claim 1, wherein the top of the sloped exterior is configured to be at the ground line.

7. The steel and foam foundation of claim 1 further comprising:
a series of fasteners, wherein the series of fasteners includes:
a fastener attaching the first flange of the first piece of L-metal to the first flange of the first I-beam;
a fastener attaching the first flange of the first piece of L-metal to the first flange of the second I-beam;
a fastener attaching the first flange of the second piece of L-metal to the second flange of the first I-beam;
a fastener attaching the first flange of the second piece of L-metal to the second flange of the second I-beam;
a fastener attaching the first flange of the third piece of L-metal to the first flange of the first I-beam;
a fastener attaching the first flange of the third piece of L-metal to the first flange of the second I-beam;
a fastener attaching the first flange of the fourth piece of L-metal to the second flange of the first I-beam; and
a fastener attaching the first flange of the fourth piece of L-metal to the second flange of the second I-beam.

8. The steel and foam foundation of claim 7, wherein each of the fasteners in the series of fasteners includes a self-tapping screw.

9. The steel and foam foundation of claim 1 further comprising:
a series of fasteners, wherein the series of fasteners includes:
a pair of fasteners attaching the first flange of the first piece of L-metal to the first flange of the first I-beam;
a pair of fasteners attaching the first flange of the first piece of L-metal to the first flange of the second I-beam;
a pair of fasteners attaching the first flange of the second piece of L-metal to the second flange of the first I-beam;
a pair of fasteners attaching the first flange of the second piece of L-metal to the second flange of the second I-beam;
a pair of fasteners attaching the first flange of the third piece of L-metal to the first flange of the first I-beam;
a pair of fasteners attaching the first flange of the third piece of L-metal to the first flange of the second I-beam;
a pair of fasteners attaching the first flange of the fourth piece of L-metal to the second flange of the first I-beam; and
a pair of fasteners attaching the first flange of the fourth piece of L-metal to the second flange of the second I-beam.

10. The steel and foam foundation of claim 1, wherein the sloped exterior is attached to:
the exterior surface of the main body;
the first flange of the first I-beam;
the first flange of the second I-beam; and
the first flange of the third piece of L-metal.

11. A structure, the structure comprising:
a steel and foam foundation, the steel and foam foundation comprising:
a main body, wherein the main body is formed of EPS foam;
a sloped exterior, wherein the sloped exterior:
is formed of EPS foam;
on an exterior surface of the main body; and
ensures that the bottom of the steel and foam foundation is wider than the top of the steel and foam foundation;
a first I-beam, wherein:
the first I-beam includes:
a web;
a first flange; and
a second flange; and
a first edge of the main body is placed along the web of the first I-beam;
a second I-beam, wherein:
the second I-beam includes:
a web;
a first flange; and
a second flange; and
a second edge of the main body:
is placed along the web of the second I-beam; and
is opposite the first edge;
a first piece of L-metal, wherein:
the first piece of L-metal includes:
a first flange; and
a second flange;
the first piece of L-metal is placed with the first flange on the exterior surface and the second flange on a third edge of the main body;
the third edge extends between the first edge and the second edge; and
the first flange of the first piece of L-metal partially overlaps:
the first flange of the first I-beam; and
the first flange of the second I-beam;
a second piece of L-metal, wherein:
the second piece of L-metal includes:
a first flange; and
a second flange;
the second piece of L-metal is placed with the first flange on an interior surface of the main body and the second flange on the third edge of the main body; and
the interior surface is opposite the exterior surface;
the first flange of the second piece of L-metal partially overlaps:
the second flange of the first I-beam; and
the second flange of the second I-beam;

a third piece of L-metal, wherein:
the third piece of L-metal includes:
a first flange; and
a second flange;
the third piece of L-metal is placed with the first flange on the exterior surface and the second flange on a fourth edge of the main body; and
the fourth edge:
extends between the first edge and the second edge; and
is opposite the third edge; and
the first flange of the third piece of L-metal partially overlaps:
the first flange of the first I-beam; and
the first flange of the second I-beam; and
a fourth piece of L-metal, wherein:
the fourth piece of L-metal:
includes:
a first flange; and
a second flange;
is placed with the first flange on the interior surface and
the second flange on the fourth edge of the main body; and
the first flange of the fourth piece of L-metal partially overlaps:
the second flange of the first I-beam; and
the second flange of the second I-beam; and
a footing, wherein the steel and foam foundation is attached to the footing.

12. The structure of claim 11, wherein the footing includes concrete.

13. The structure of claim 11, wherein the distance between the interior surface and the exterior surface is approximately 8 inches.

14. The structure of claim 13, wherein
the first flange of the of the first piece of L-meal is approximately 1.5 inches wide;
the first flange of the of the second piece of L-meal is approximately 1.5 inches wide;
the first flange of the of the third piece of L-meal is approximately 3.5 inches wide; and
the first flange of the of the fourth piece of L-meal is approximately 3.5 inches wide.

15. The structure of claim 14, wherein:
the second flange of the of the first piece of L-meal is approximately 3 inches wide;
the second flange of the of the second piece of L-meal is approximately 3 inches wide;
the second flange of the of the third piece of L-meal is approximately 3 inches wide; and
the second flange of the of the fourth piece of L-meal is approximately 3 inches wide.

16. A structure, the structure comprising:
a steel and foam foundation, the steel and foam foundation comprising:
a main body, wherein the main body is formed of EPS foam;
a sloped exterior, wherein the sloped exterior:
is formed of EPS foam;
on an exterior surface of the main body; and
ensures that the bottom of the steel and foam foundation is wider than the top of the steel and foam foundation;
a first I-beam, wherein:
the first I-beam includes:
a web;
a first flange; and
a second flange; and
a first edge of the main body is placed along the web of the first I-beam;
a second I-beam, wherein:
the second I-beam includes:
a web;
a first flange; and
a second flange; and
a second edge of the main body:
is placed along the web of the second I-beam; and
is opposite the first edge;
a first piece of L-metal, wherein:
the first piece of L-metal includes:
a first flange; and
a second flange;
the first piece of L-metal is placed with the first flange on the exterior surface and the second flange on a third edge of the main body;
the third edge extends between the first edge and the second edge; and
the first flange of the first piece of L-metal partially overlaps:
the first flange of the first I-beam; and
the first flange of the second I-beam;
a second piece of L-metal, wherein:
the second piece of L-metal includes:
a first flange; and
a second flange;
the second piece of L-metal is placed with the first flange on an interior surface of the main body and the second flange on the third edge of the main body; and
the interior surface is opposite the exterior surface;
the first flange of the second piece of L-metal partially overlaps:
the second flange of the first I-beam; and
the second flange of the second I-beam;
a third piece of L-metal, wherein:
the third piece of L-metal includes:
a first flange; and
a second flange;
the third piece of L-metal is placed with the first flange on the exterior surface and the second flange on a fourth edge of the main body; and
the fourth edge:
extends between the first edge and the second edge; and
is opposite the third edge; and
the first flange of the third piece of L-metal partially overlaps:
the first flange of the first I-beam; and
the first flange of the second I-beam; and
a fourth piece of L-metal, wherein:
the fourth piece of L-metal:
includes:
a first flange; and
a second flange;
is placed with the first flange on the interior surface and
the second flange on the fourth edge of the main body; and
the first flange of the fourth piece of L-metal partially overlaps:
the second flange of the first I-beam; and
the second flange of the second I-beam;

a footing, wherein the steel and foam foundation is attached to the footing;

a floor panel placed on top of the third edge of the main body and attached to the first piece of L-metal and the second piece of L-metal;

waterproofing, wherein the waterproofing is applied to at least the sloped exterior;

an exterior wall, the exterior wall placed on top of the floor panel; and an exterior finish, wherein the exterior finish covers:

a portion of the main body;

the first flange of the first I-beam;

the first flange of the second I-beam;

the first flange of the first piece of L-metal;

a portion of the floor panel; and a portion of the exterior wall.

17. The structure of claim 16, wherein the waterproofing includes an asphalt spray.

18. The structure of claim 16, further comprising fill dirt, wherein the fill dirt is placed to cover the exterior surface and the waterproofing.

19. The structure of claim 16, wherein the exterior finish includes crete.

20. The structure of claim 16, further comprising fill, wherein the fill is placed around the structure on the exterior of the waterproofing.

* * * * *